US007048572B1

(12) United States Patent
Ting

(10) Patent No.: US 7,048,572 B1
(45) Date of Patent: May 23, 2006

(54) NETWORK TRANSMISSION MEDIUM

(76) Inventor: Shao-Chieh Ting, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 11/038,196

(22) Filed: Jan. 21, 2005

(51) Int. Cl.
*H01R 11/20* (2006.01)

(52) U.S. Cl. ..... 439/418; 439/941; 439/676

(58) Field of Classification Search ..... 439/418, 439/941, 676, 344, 521, 944, 660, 402–405, 439/668, 519, 417
See application file for complete search history.

(56) References Cited

U.S. PATENT DOCUMENTS 4,260,209 A * 4/1981 Zell et al. ..... 439/443
6,007,368 A * 12/1999 Lorenz et al. ..... 439/418
6,409,544 B1 * 6/2002 Wu ..... 439/608
6,716,056 B1 * 4/2004 Hsu ..... 439/417
6,764,333 B1 * 7/2004 Pocrass ..... 439/418
6,821,142 B1 * 11/2004 Rayev et al. ..... 439/418

* cited by examiner

*Primary Examiner*—Gary F Paumen
*Assistant Examiner*—Edwin A. Leon
(74) *Attorney, Agent, or Firm*—Troxell Law Office, PLLC

(57) ABSTRACT

A network transmission medium includes a transmission cable with signal wires, a pair of connector bases, a pair of base covers for respectively covering an external portion of each of the connector bases, and a plurality of conductive terminals. At each end of the signal wires are inserted interior of one of the connector bases, and the signal wires are adapted so as to protrude outside of the connector base. The signal wires protruding outside the connector base are trimmed so as to become level with an outer side surface of the connector base, and the signal wires are then fixed to the connector base, with length of the signal wires remaining interior of the connector base being approximately 6.4 mm. Furthermore, the conductive terminals inserted in the connector base are configured so as to pierce the signal wires and thereby effectuate contact with cores of the signal wires.

4 Claims, 6 Drawing Sheets

NETWORK TRANSMISSION MEDIUM

BACKGROUND OF THE INVENTION (a) Field of the Invention

The present invention relates to design of a network communication transmission medium, and more particularly to the transmission medium that rapidly effectuates connection of a transmission cable to a connector terminal, thereby facilitating connecting the transmission cable to a connector base.

(b) Description of the Prior Art

Advancement of the information age has made the Internet become an essential communication system of today, and usage of the Internet allows more rapid and convenient searching and transmitting of data therewith.

Furthermore, the Internet can not only be utilized for searching and transmitting of data, moreover, the Internet can also be utilized to implement multinational online conferencing, thereby shortening mutual distance and increasing transmission speed of required mutual communicable information.

However, apart from necessity for a host device to connect to and thereby implement application of the Internet, moreover, signals are necessarily transmitted through a telecommunications operator, and, more importantly, the information signals are necessarily transmitted through a network transmission medium.

Quality of the network transmission medium is one factor that decides speed of transmission. The network transmission medium can be divided into two categories, one category being that which pertains to wireless transmission, and the other category pertains to wired transmission. Wireless transmission necessarily employs specific transmission components in order to implement transmission and reception.

Wired transmission necessarily employs wiring connections in order to achieve effectiveness of transmission and reception, and apart from the wiring connections, moreover, wired transmission necessarily utilizes a connecting medium configured on each of two terminal host devices, and therewith reception and transmission of the information signals can be implemented. An existing wired transmission medium, as depicted in FIG. 1, primarily utilizes a transmission cable fixedly configured in an inner sleeve (A) interior of a connector base, and through grooves (A1) defined in the inner sleeve (A), which provide for configuring signal wires (11) inside the transmission cable therethrough. Furthermore, a groove (A2) is formed above the central through groove (A1). The through grooves (A1) and the groove (A2) provide for configuredly laying the signal wires (11) therewithin, and thereby the signal wires (11) are sleeved inside of the connector base.

However, such a structural configuration results in inability to effectively secure fastening of the signal wires (11) configured within the through grooves (A1) and the groove (A2). Furthermore, if the signal wires (11) are excessively long (approximately 13 mm and above), because configuration adopted by the signal wires (11) inside of the transmission cable is such to present a twisted state (an interlaced configuration), thus, the longer exposed lengths of the signal wires (11) are, correspondingly, the larger is interspacing of the signal wires (11) in the twisted state, resulting in slower effectiveness of signal transmission, and, moreover, the signals are easily subject to interference.

Furthermore, in fabricating such a configuration, the signal wires (11) configuredly layered on the groove (A2) are necessarily flexed at a rear end of the connector base in order to fasten together with the signal wires (11) that have been sleeved and thereby configured within the through grooves (A1), and thereby effectuate sleeving of the signal wires (11) inside of the connector base. However, such a configuration results in inability to effectively secure fastening of the signal wires (11) of the groove (A2), which causes inconvenience in structural assembly, and often results in damage to the transmission medium. Hence, subject of the present invention is resolving and surmounting existent technical difficulties to provide the network transmission medium that allows for convenient and rapid connective assembly thereof.

SUMMARY OF THE INVENTION

In light of the aforementioned problems that have been put off for too long, and extreme necessity to resolve such, the inventor of the present invention, having accumulated years of experience in research, design and manufacturing of related products, has attentively and circumspectly carried out extensive study and exploration, and applied professional insight and knowledge to ultimately successfully design an improved structure for a network transmission medium of the present invention.

Hence, the network transmission medium of the present invention primarily comprises a transmission cable, a pair of connector bases, a pair of base covers for respectively close-fit covering an external portion of each of the connector bases, and a plurality of conductive terminals.

At each end of the transmission cable signal wires inside the transmission cable are inserted interior of each of the connector bases, and the signal wires are adapted so as to protrude outside of the connector base. The signal wires protruding outside the connector base are then trimmed so as to become level with an outer side surface of the connector base, and the signal wires are then fixed to the connector base, with length of the signal wires remaining interior of the connector base being approximately 6.4 mm. Furthermore, the conductive terminals inserted in the connector base are configured so as to pierce the signal wires and thereby effectuate contact with cores of the signal wires, thus achieving objective of network transmission. In order to prevent a short circuit, oxidization and erosion from moisture, the base covers are inserted in connector ends at front ends of the connector bases to cover through holes.

A primary objective of the present invention is to provide the network transmission medium, whereby at each end of the transmission cable the signal wires are sleeved inside one of the connector bases, allowing length of the signal wires exposed to be approximately 6.4 mm, and simultaneously narrowing spacing of the twisted signal wires (configured in an interlaced fashion), thereby achieving effectiveness of reenforcing signal transmission of the network transmission medium, and enhancing effectiveness of preventing interference.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
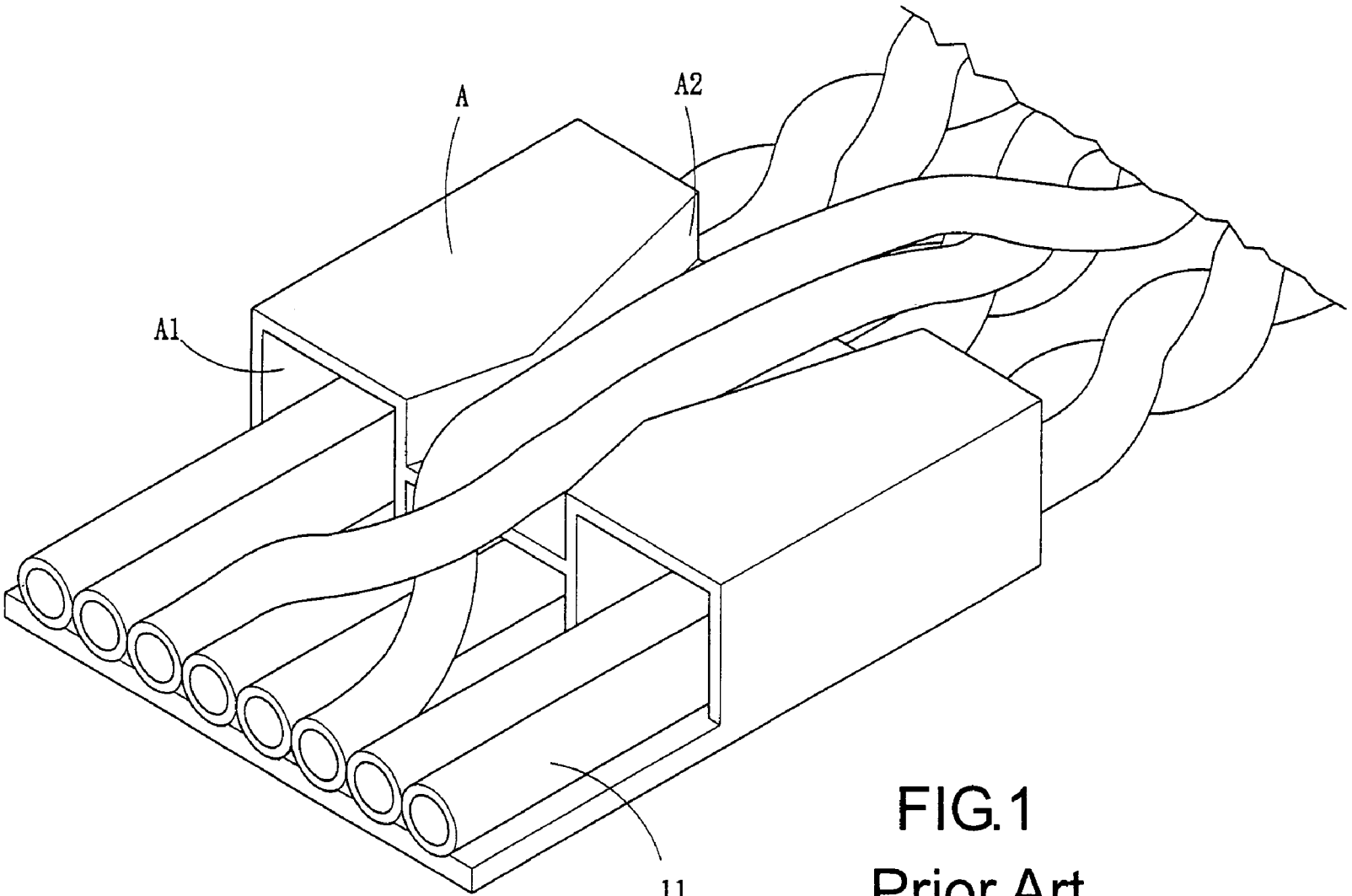
FIG.1 Prior Art
FIG. 1 shows a schematic view of a conventional connector base.
Figure 2:
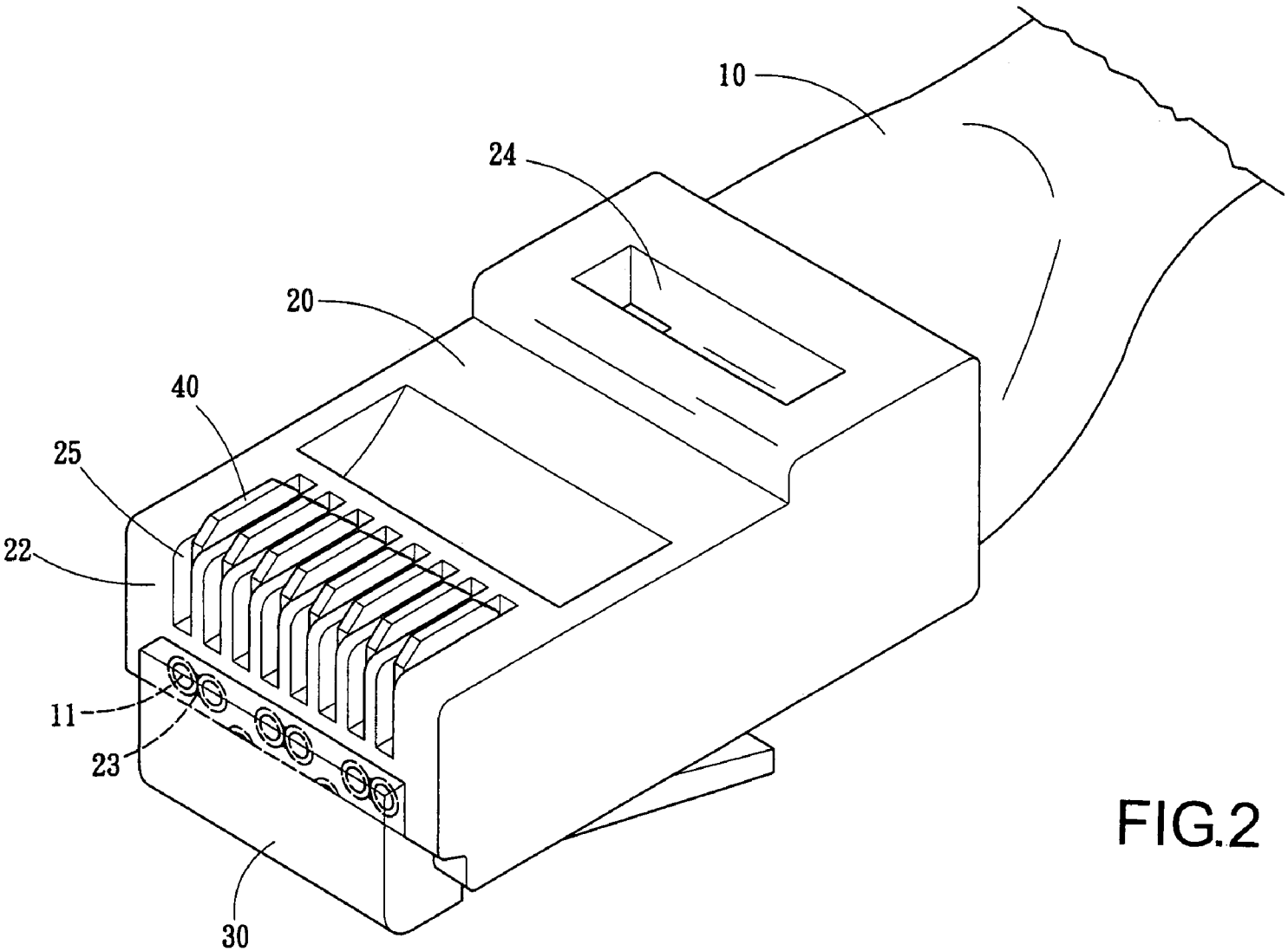
FIG. 2 shows a schematic view according to the present invention.
Figure 3:
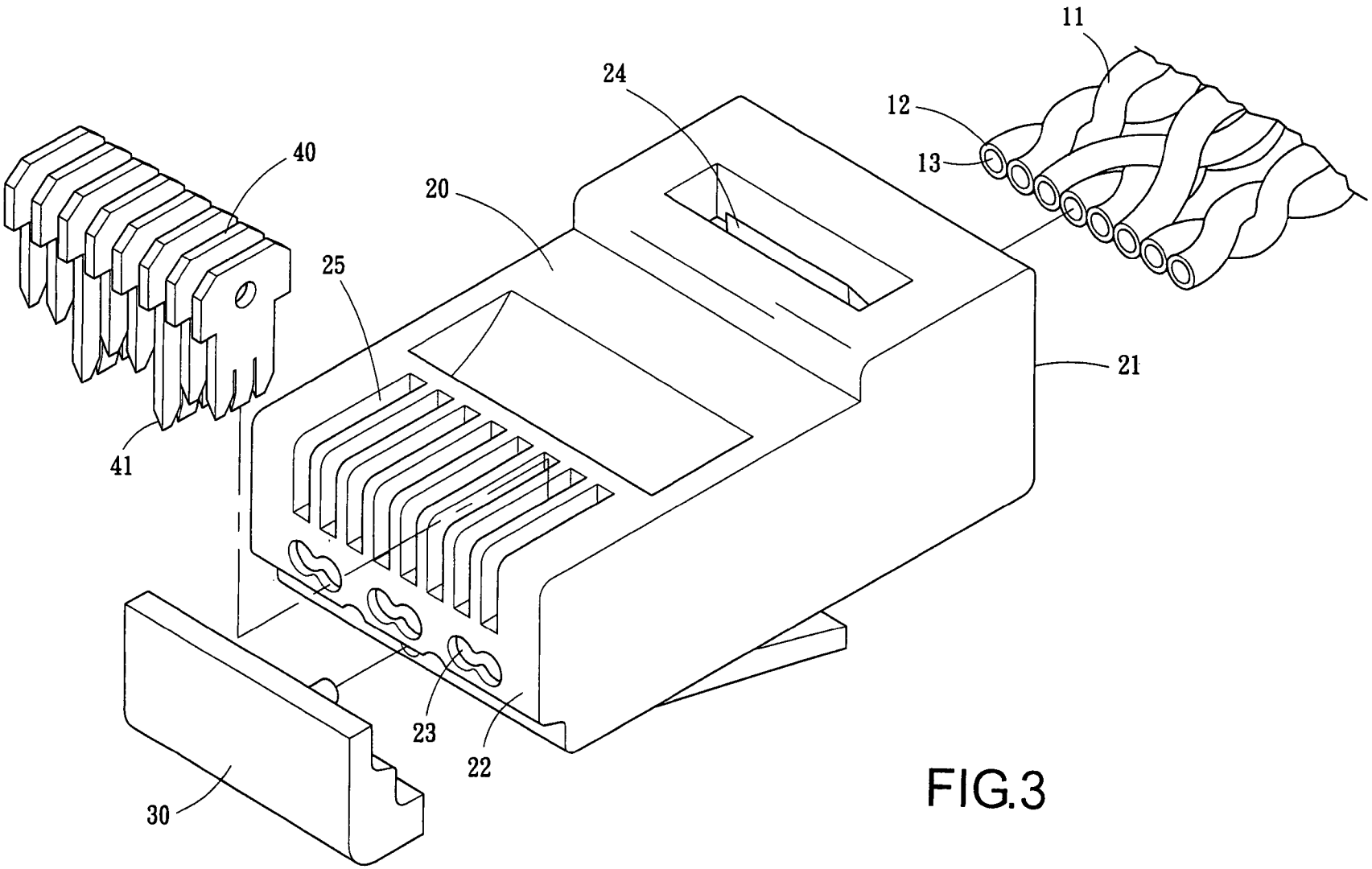
FIG. 3 shows an exploded schematic view according to the present invention.

Referring to FIGS. 2 and 3, which show structure of a network transmission medium of the present invention primarily configured to comprise a transmission cable (10), a connector base (20), a base cover (30) and a plurality of conductive terminals (40), wherein:

A plurality of signal wires (11) are enclosed interior of the transmission cable (10), and exterior of each of the signal wires (11) is covered with an insulation layer (12). A core (13) is disposedly configured interior of each of the signal wires (11); moreover, configuration adopted by the signal wires (11) inside of the transmission cable is such to present a twisted state (an interlaced configuration).

The connector base (20) is respectively configured on each of two extremities of the transmission cable (10). The connector base (20) is formed as an integrated unit, and one end of the connector base (20 provides an insertion end (21) for each of the two extremities of the transmission cable (10) to respectively insert thereinto, and another end of the connector base (20) provides a connector end (22) for the signal wires (11) at each extremity of the transmission cable (10) to pass therethrough, whereby the connector end (22) is structured to comprise through holes (23). Interior of the connector base (20) is provided with a containment space, and a locating piece (24) is configured on one side of an external portion close to the insertion end (21) of the connector base (20). A plurality of locating grooves (25) are defined in a position close to the connector end (22).

The base cover (30) covers an external portion of the connector end (22) of the connector base (20) covering the through holes (23) and thereby preventing a short circuit, oxidization and erosion from moisture.

Figure 4:
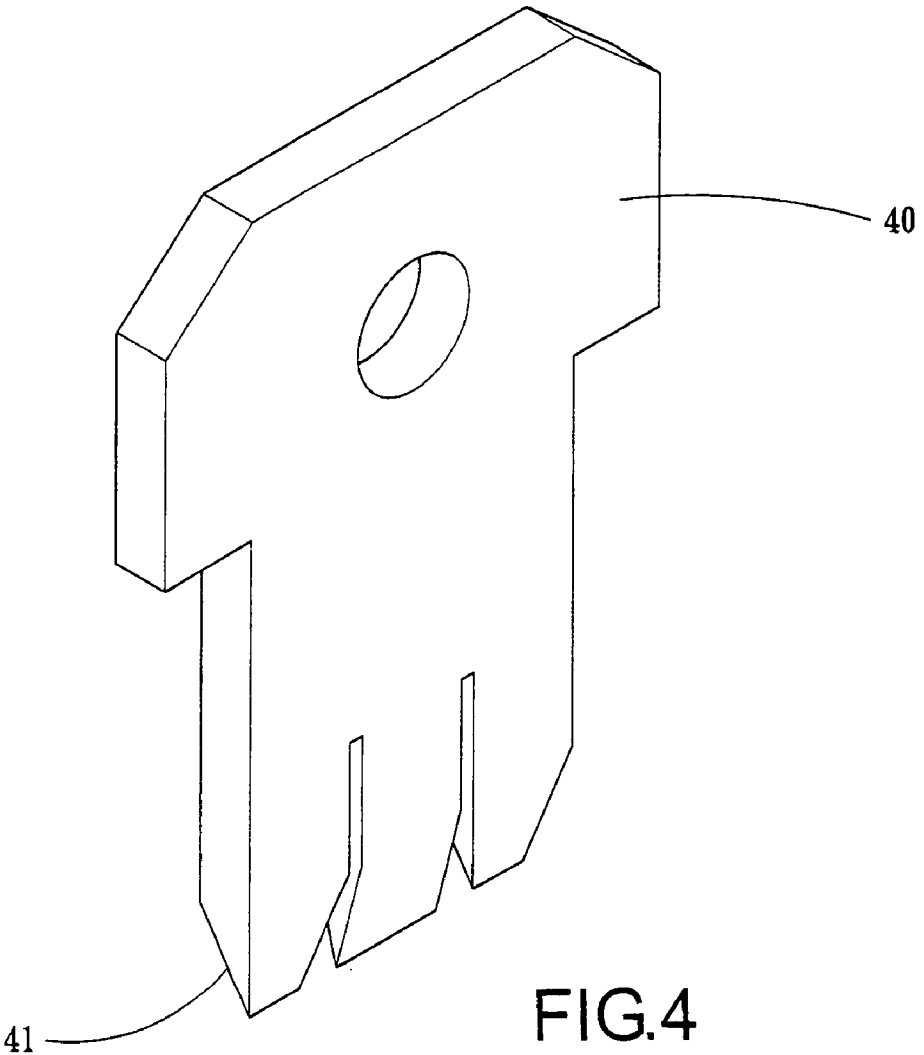
FIG. 4 shows a schematic view of a conductive terminal according to the present invention.

With additional reference to FIG. 4, which shows one of the conductive terminals (40), each of which are respectively inserted and thereby configured within each of the locating grooves (25) of the connector base (20). Moreover, a plurality of pins (41) each having a cusp form are configured on an end of each of the conductive terminals (40) so as to correspond to each of the locating grooves (25), and that pierce the signal wires (11) configured interior of the connector base (20), thereby effectuating contact with the cores (13) interior of each of the signal wires (11).

Figure 5:
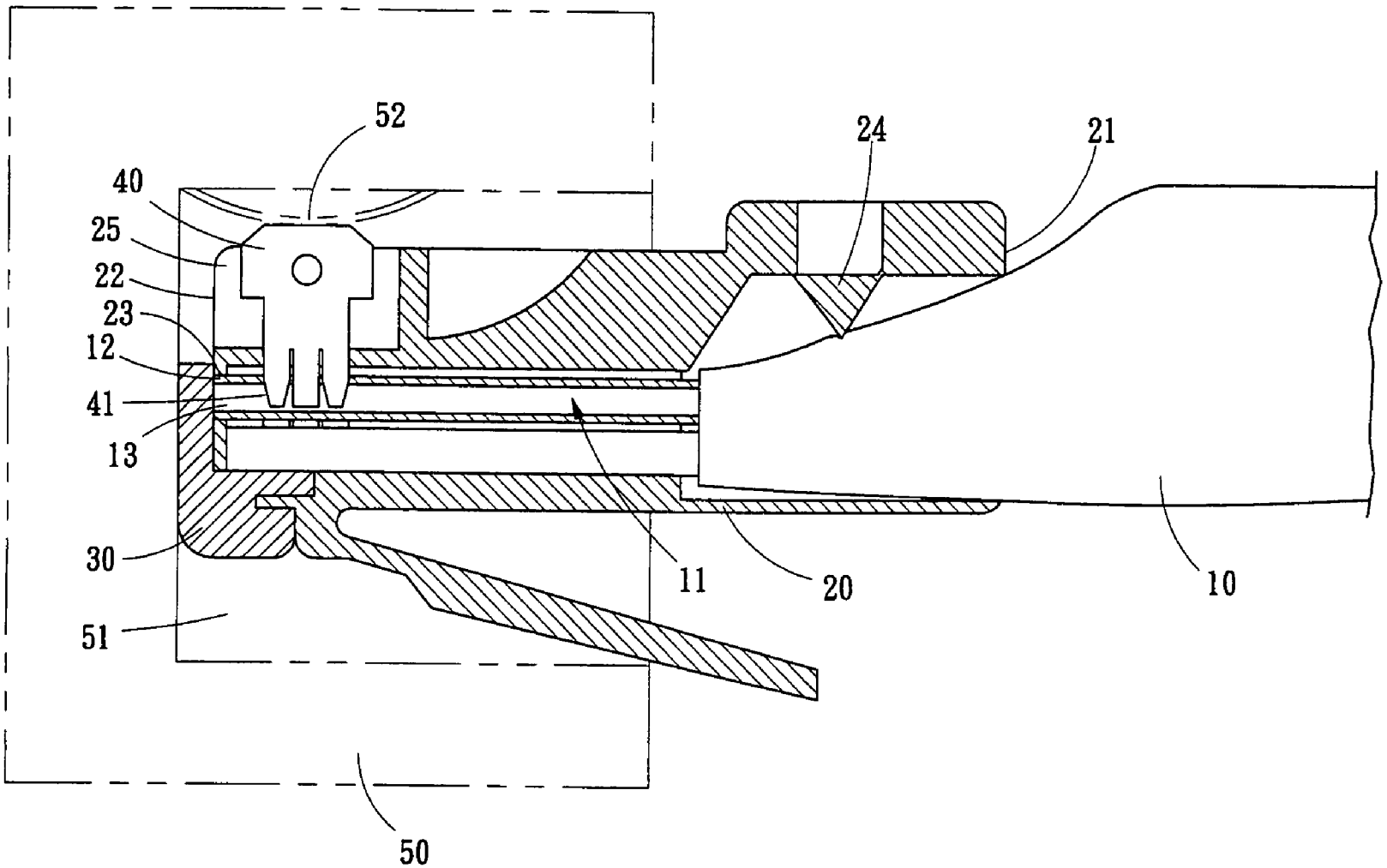
FIG. 5 shows a cross-sectional view according to the present invention.

According to the aforementioned, and with additional reference to FIG. 5, after pulling straight the signal wires (11) of the transmission cable (10), the transmission cable (10) is thereupon inserted within the containment space of the insertion end (21) of the connector base (20), whereupon the signal wires (11) are made to respectively pass through the through holes (23), thereby enabling the signal wires (11) to protrude external of the connector end (22) of the connector base (20). The signal wires (11) are then trimmed so as to become level with an outer side surface of the connector end (22) of the connector base (20), and the locating piece (24) is thereupon inwardly pressed, thereby allowing the transmission cable (10) to become fixedly configured interior of the connector base (10). The base cover (30) is then utilized to cover the external portion of the connector end (22) of the connector base (10), and, lastly, each of the conductive terminals (40) are respectively inserted within each of the locating grooves (25), thereby enabling the pins (41) configured on a cusp of each of the conductive terminals (40) to respectively pierce the insulation layer of the signal wires (11) interior of the connector base (20), and thus come in respective contact with the cores (13) of each of the signal wires (11).

According to such a configuration, each of the conductive terminals (40) are respectively fixedly secured within each of the locating grooves (25), moreover, the conductive terminals (40) are adapted to protrude outside of the locating grooves (25), thereby when proceeding with connecting the connector base (20) into an insertion slot (51) of a host device (50) by means of the connector end (22), the conductive terminals (40) protruding outside of the connector base (20) effectuate forming an electrical contact state with terminals (52) configured interior of the insertion slot (51).

A signal received or transmitted through the conductive terminals (40) can thus be transmitted to the cores (13) of the signal wires (11), and thereon reception of the signal can be proceeded with or the signal can be transmitted to another end of the transmission cable (10), thereby achieving effectiveness of signal transmission or reception through the connector base (20) configured on the two extremities of the transmission cable (10).

Figure 6:
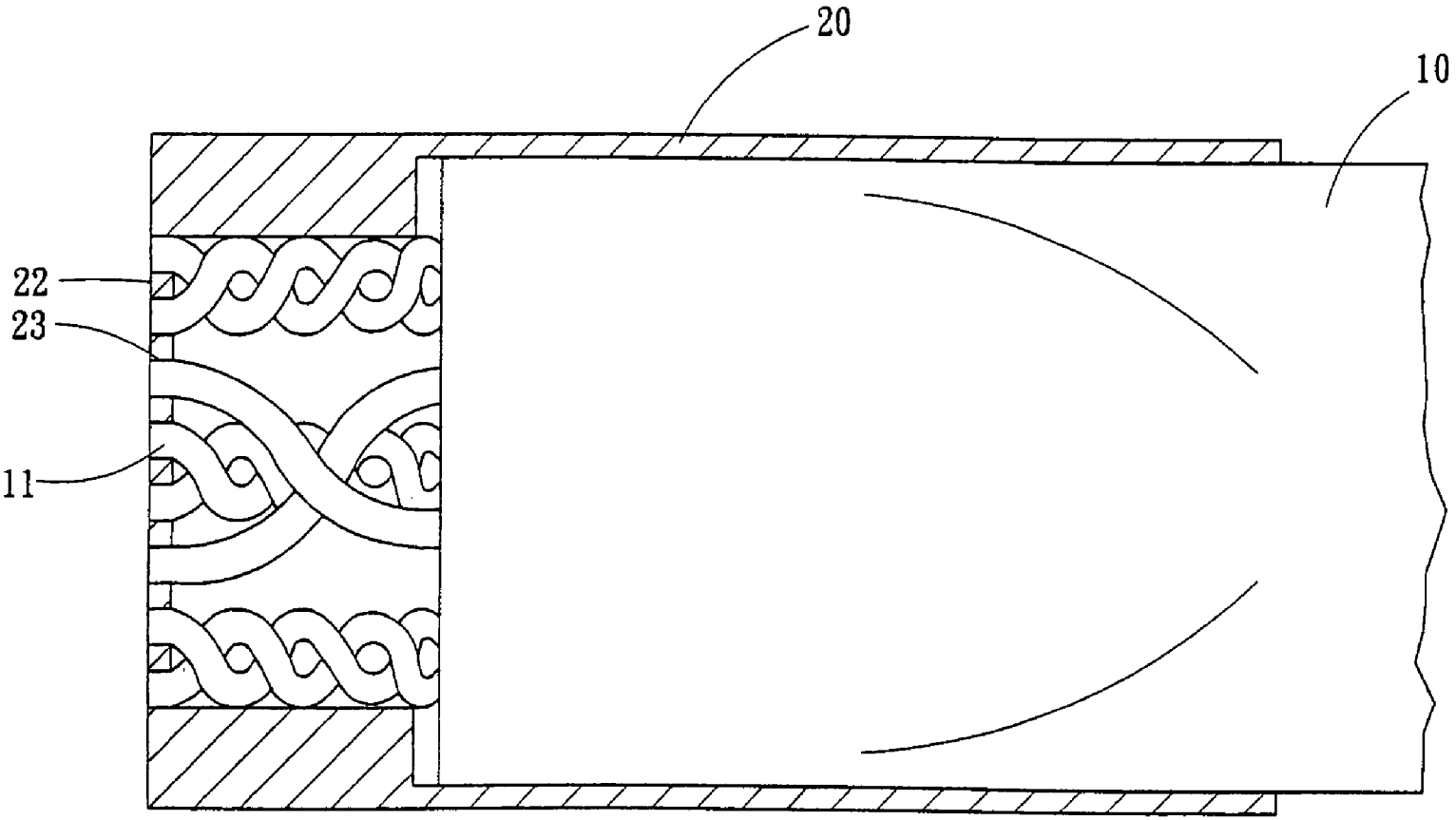
FIG. 6 shows a sectional view of signal wires and a connector base after assembling according to the present invention.

Referring to FIGS. 3 and 6, it is worth mentioning that after the signal wires (11) have been sleeved within the connector base (20), and the signal wires (11) have been made to protrude outside of the connector base (20), the signal wires (11) outside of the connector base (20) are thereupon pulled straight, and because the configuration adopted by the signal wires (11) inside of the transmission cable (10) is such to present the twisted state (the interlaced configuration), thus by utilizing method of outward pulling of the signal wires (11), narrowing spacing of the twisted signal wires (11) is realized. Furthermore, length of the signal wires (11) exposed is maintained at approximately 6.4 mm, thereby achieving effectiveness of reenforcing signal transmission, and simultaneously enhancing effectiveness of preventing interference.

In order to prevent the signal wires (11) in the through holes (23) from short-circuiting, oxidizing and eroding because of moisture, the base covers (30) are respectively disposed on the connector ends of the front ends of the connector bases (20), thereby protecting the signal wires (11). In conclusion, according to the aforementioned configuration, convenience in connective assembly of the transmission cable (10) to the connector base (20) is realized, which thus effectuates rapid assembly, and enhances productivity, moreover, transmission effectiveness of the network transmission medium is ensured.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A network transmission medium comprising:

a) a transmission cable having a plurality of signal wires, each of the plurality of signal wires having a core and an insulation layer covering the core layer;

b) two connector bases, each of the two connector bases having:

i) a containment space;

ii) a insertion end having a locating piece, one of two opposing ends of the transmission cable is inserted into the containment space through the insertion end, the locating piece protruding into the containment space and engaging the transmission cable; and iii) a connector end having a plurality of through holes and a plurality of locating grooves, the plurality of holes and the plurality of locating grooves communicating with the containment space and an exterior of the connector end, the plurality of signal wires protruding through the plurality of through holes and aligning with the exterior of the connector end;

c) a base cover connected to the connector end in a direction parallel to the longitudinal axis of the connector base; and d) a plurality of conductive terminals inserted into the plurality of locating grooves, each of the plurality of conductive terminals having a plurality of pins, the plurality of pins of one of the plurality of conductive terminals piecing the insulation layer and engaging the core of each of the plurality of signal wires.

2. The network transmission medium according to claim 1, wherein end portions of the plurality of signal wires located on the two opposing ends of the transmission cable are positioned parallel in the connector end, and a middle portion of the plurality of signal wires located between the end portions thereof are interlaced.

3. The network transmission medium according to claim 1, wherein the base covers the plurality of through holes and the plurality of signal wires contained therein.

4. The network transmission medium according to claim 1, wherein the plurality of conductive terminals protrudes outwardly from each of the two connector bases above the connector end.

* * * * *